United States Patent [19]

Carroll et al.

[11] 3,970,810

[45] July 20, 1976

[54] ELECTRIC CIRCUIT BREAKER COMPRISING PARALLEL-CONNECTED VACUUM INTERRUPTERS

[75] Inventors: James J. Carroll, Turnersville; Graham R. Mitchell, Willingboro, both of N.J.

[73] Assignee: General Electric Company, Philadelphia, Pa.

[22] Filed: Mar. 6, 1975

[21] Appl. No.: 556,077

[52] U.S. Cl. ..... 200/144 B; 317/11 R; 313/231

[51] Int. Cl.[2] ..... H01H 33/66

[58] Field of Search ..... 200/144 B; 317/11; 313/231, 217

[56] References Cited

UNITED STATES PATENTS

| | | | |
|---|---|---|---|
| 2,897,322 | 7/1959 | Reece | 200/144 B |
| 3,036,180 | 5/1962 | Greenwood | 200/144 B |
| 3,154,655 | 10/1964 | Hawkins | 200/144 B |
| 3,321,598 | 5/1967 | Streater | 200/144 B |
| 3,432,713 | 3/1969 | Lafferty | 200/144 B X |
| 3,441,800 | 4/1969 | Lee | 317/11 |
| 3,469,048 | 4/1969 | Lee et al. | 200/144 B |
| 3,470,341 | 9/1969 | Beddoe | 200/144 B |

FOREIGN PATENTS OR APPLICATIONS

| | | | |
|---|---|---|---|
| 460,122 | 9/1968 | Switzerland | 200/144 B |
| 1,067,481 | 5/1967 | United Kingdom | 200/144 B |

*Primary Examiner*—Robert S. Macon
*Attorney, Agent, or Firm*—William Freedman; J. Wesley Haubner

[57] ABSTRACT

This electric circuit breaker comprises a plurality of vacuum-type circuit interrupters electrically connected in parallel with each other and means for opening the interrupters substantially simultaneously during circuit interruption. Each interrupter comprises an evacuated envelope and a pair of relatively-movable contacts located within the envelope to provide an inter-contact gap across which arcing can occur during circuit interruption. The stationary contacts of the two interrupters are respectively mounted on stationary contact rods that have their outer ends closely adjacent each other. A communicating passageway extends between the two inter-contact gaps through the stationary contacts and the stationary contact rods for conveying arcing products from any inter-contact gap that is then arcing to any that is not then arcing, thereby promoting concurrent arcing at said gaps during high-current interruptions.

10 Claims, 5 Drawing Figures

ELECTRIC CIRCUIT BREAKER COMPRISING PARALLEL-CONNECTED VACUUM INTERRUPTERS

BACKGROUND

This invention relates to an electric circuit breaker of the type that comprises a plurality of vacuum-type circuit interrupters electrically connected in parallel with each other.

A circuit breaker of this type is shown and claimed in application Ser. No. 548,847-Mitchell, filed Feb. 10, 1975, and assigned to the assignee of the present invention. In the Mitchell circuit breaker, the parallel-connected interrupters are opened substantially simultaneously during an interrupting operation, and the total current through the circuit breaker under high-current interrupting conditions is shared by the interrupters, thus reducing the interrupting duty on each interrupter. A problem encountered in this type of circuit breaker is assuring that arcs will be established concurrently in all the parallel-connected interrupters during high-current interruptions so that the total current can be shared generally equally by the interrupters. Assuming that there are two parallel-connected interrupters, a situation in which it is especially difficult to assure concurrent arcing in both interrupters is when the contacts of one interrupter part just prior to a natural current zero and the contacts of the other interrupter part just after natural current zero. In such a situation, immediately after natural current zero, all the current passes through the contacts still in engagement; and when these latter contacts part, there is a tendency for arcing to occur only between these latter contacts.

For assuring concurrent arcing in the parallel-connected interrupters during high-current interruptions, even under such circumstances, Mitchell provides a communicating passage between the interrupters through which ionized arcing products can readily pass from any inter-contact gap then arcing to one not then arcing, thereby forcing an arc-over of the intact gap. To accommodate this communicating passage, Mitchell utilizes for each of his interrupters a design that is characterized by an envelope comprising a tubular metal housing surrounding the arcing gap of the interrupter and a generally radially extending opening in this tubular metal housing leading to the communicating passage.

This approach, however, is not usable with most vacuum interrupter designs because in the usual design the envelope includes no such metal housing surrounding the arcing gap. Usually, this portion of the envelope is primarily of insulating material and therefore does not readily lend itself to the incorporation of a passageway therethrough. Providing a hole in an insulating wall and sealing an appropriate pipe or conduit thereto involves a major and expensive reconstruction of the envelope.

SUMMARY

An object of our invention is to provide for free communication between the inter-contact gaps of parallel-connected interrupters in a way that readily lends itself to use with interrupters that include envelopes that are of insulating material in the region surrounding their inter-contact gaps.

Another object is to achieve the objective of the immediately preceding paragraph without the need for making a hole in the insulating material of the envelope and without the need for adding seals between insulating material and metal.

Another object is to achieve the above two objectives in a way that requires essentially no modification of the envelope structure of the vacuum interrupters.

In carrying out the invention in one form, we provide a pair of vacuum-type circuit-interrupting units electrically connected in parallel-circuit relationship with each other and means for opening the interrupting units substantially simultaneously during circuit interruption. Each interrupting unit comprises: a pair of separable contacts and a stationary contact rod having an inner end on which one of said contacts is mounted and an outer end supported on a conductive end plate of the interrupting unit. The stationary contact rod and the contact mounted thereon contain a conduit that extends between the inter-contact gap and the outer end of the contact rod. The interrupting units are mounted in such positions that the outer ends of the stationary contact rods of two interrupting units are closely adjacent each other and generally in alignment. Connecting means located between the outer ends of the contact rods provides a communicating passage between the conduits for conveying arcing products from either inter-contact gap that is then arcing to either inter-contact gap that is not then arcing, thereby promoting concurrent arcing at said two gaps during high-current interruptions. The passageway comprising said conduits and said communicating passage extends between the inter-contact gaps via a substantially straight-line path.

BRIEF DESCRIPTION OF DRAWINGS

For a better understanding of the invention, reference may be had to the following description taken in conjunction with the accompanying drawings, wherein.

DETAILED DESCRIPTION OF PREFERRED EMBODIMENTS

Figure 1:
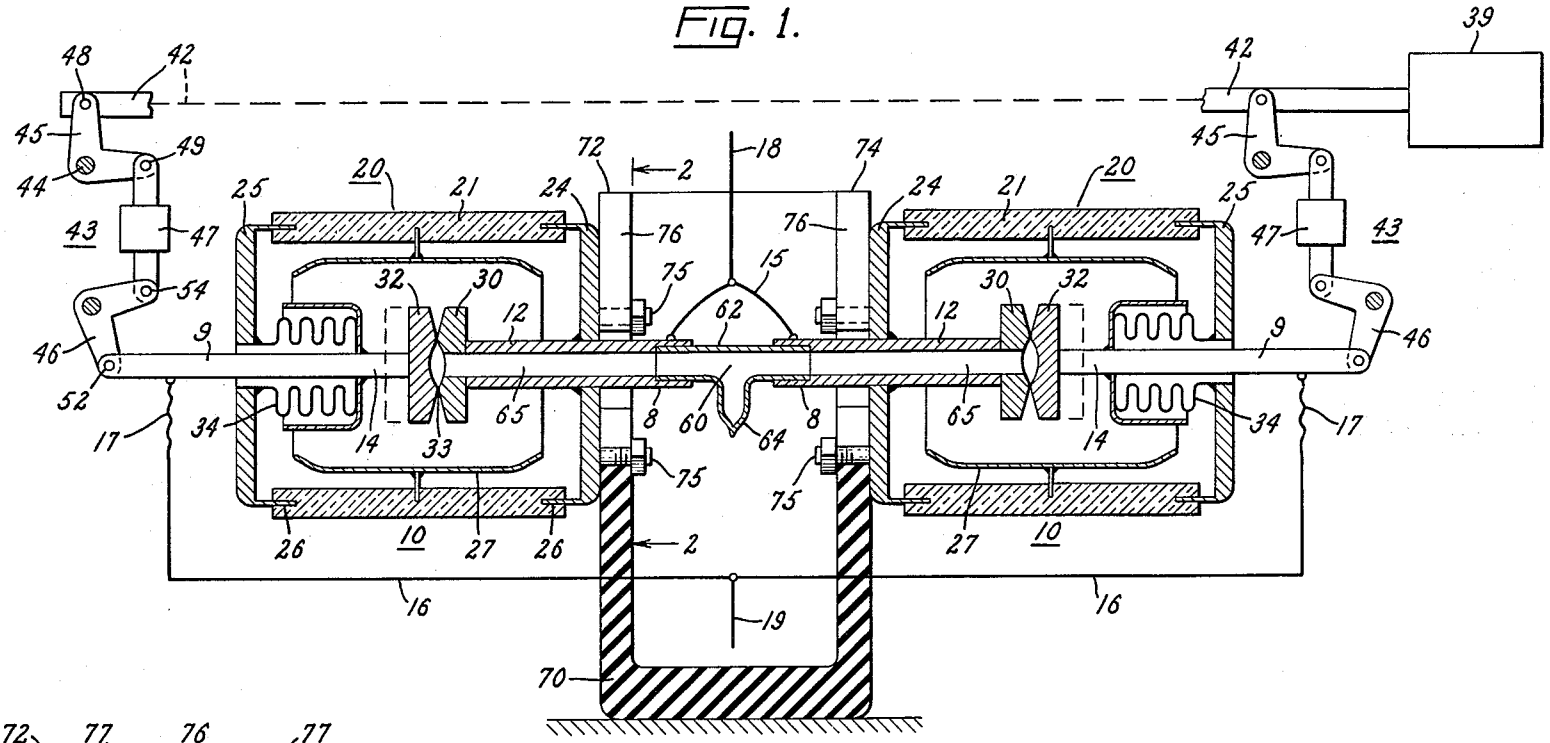
FIG. 1 is a side elevational view, partly in section, showing a vacuum-type circuit breaker embodying one form of the invention.

Referring now to FIG. 1, there is shown a vacuum circuit breaker comprising an interrupter assembly that includes two vacuum-type circuit interrupters 10 electrically connected in parallel with each other. Since the circuit interrupters are substantially identical, corresponding reference numerals are used to designate corresponding parts of the two interrupters.

Each interrupter comprises two spaced-apart terminals 8 and 9 respectively constituted by the outer ends of contact rods 12 and 14. The two terminals 8 are electrically connected together by a conductor 15, and the two terminals 9 are electrically connected together by a conductor 16 including end portions 17 made flexible to avoid interference with the desired movement of contact rods 14. The interrupter assembly is provided with its own terminal conductors 18 and 19 for electrically connecting it into one phase of an alternating-current power circuit. It is to be understood that the conductors 15–19 are shown in diagrammatic form only.

Each interrupter comprises a highly evacuated envelope 20 which comprises a tubular casing, or housing, 21 of insulating material, such as glass, and end caps 24 and 25 joined to opposite ends of casing 21 by conventional glass-to-metal seals 26. Within the evacuated envelope 20 there is a pair or relatively-movable contacts 30 and 32. Contact 30 is a stationary contact of disc shape suitably joined to the inner end of stationary contact rod 12. Contact rod 32 is a movable contact of disc shape suitably joined to the inner end of movable contact rod 14. The stationary contact rod 12 extends through end cap 24 and is suitably sealed thereto. The movable contact rod 14 extends freely through an opening in the opposite end cap 25 and is sealed to end cap 25 by a flexible metal bellows 34 which permits horizontal reciprocation of contact rod 14 with respect to end cap 25 without impairing the vacuum inside envelope 20.

When the circuit breaker is closed, as shown in FIG. 1, the disc-shaped contacts 30 and 32 of each interrupter engage each other along annular contact-making surfaces 33, thus providing a conductive path through the interrupter between its terminals 8 and 9. Circuit interruption is effected by driving movable contact 32 of each interrupter from its solid line position of FIG. 1 into its dotted line position, thereby establishing a gap between the mating contacts across which an arc is developed during the circuit-interrupting operation. Current flows through the arc until substantially the instant of natural current zero, following which the arc is usually prevented from reigniting by the high dielectric strength of the vacuum.

For protecting the inner surface of the casing 21 against the deposition thereon of arc-generated metallic particles, a tubular metal shield 27 is provided about the contacts. This shield acts in a known manner to intercept and condense most of the radially-outwardly projected particles before they can reach the casing 21.

Figure 2:
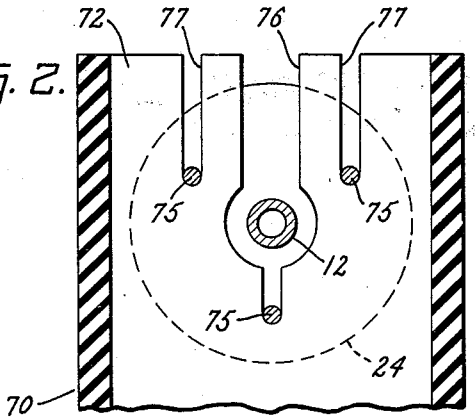
FIG. 2 is a sectional view along the line 2—2 of FIG. 1.

In this circuit breaker, the two interrupters are opened substantially simultaneously by a common operating mechanism (shown in block form at 39) that is coupled to the movable contact rods 14 through a common operating rod 42 and two separate linkages 43 mechanically in parallel. Each linkage 43 is of conventional design and, as such, comprises a pair of bellcranks 45 and 46 interconnected by a conventional wipe device 47, such as depicted in FIGS. 1 and 2 of U.S. Pat. No. 3,180,960-Barkan et al. The upper bellcrank 45 is pivotally mounted on a stationary pivot 44 and has one arm pivotally connected at 48 to the operating rod 42 and its other arm pivotally connected at 49 to wipe device 47. The other bellcrank 36 has one arm pivotally connected at 52 to the movable contact rod 14 and its other arm pivotally connected at 54 to the wipe device 47.

When the common operating rod 42 is driven to the right from its position of FIG. 1, it pivots bellcrank 45 of each linkage 43 in a clockwise direction, and this motion is transmitted to the associated contact rod 14 through the wipe device 47 and bellcrank 46, thereby driving the contact rod 14 outwardly of its associated interrupter. Such outward motion separates each of the contacts 32 from its stationary contact 30. The linkages are adjusted so that the contacts of the two interrupters part substantially simultaneously during the circuit-interrupting operation.

During a circuit-interrupting operation, if the contacts of both interrupters are separated will ahead of a natural current zero, an arc will usually be drawn in each interrupter and the desired sharing of the total interrupting current will take place. However, if the contacts of one interrupter part just before natural current zero and those of the other interrupter just after natural current zero, it is more difficult to assure arcing in the two interrupters. Even if an arc can be established before current zero across the first set to part, it is difficult to reignite this arc after current zero if the other contacts are still in engagement. After current zero in this particular situation, all of the current passes through the contact still in engagement; and when these latter contacts part to establish an arc, all of the current tends to flow through this new arc.

We overcome this problem by providing a communicating passage 60 between the inter-contact gaps of the two interrupters. If for any reason, such as above described, only one of the gaps arcs over, arcing products from the resulting arc will flow through this passage 60 into the region of the intact gap, drastically reducing its dielectric strength and causing it also to arc-over.

The passage 60 is defined by the bore of a short metal tube 62 that is suitably brazed at its opposite ends to the juxtaposed outer ends of stationary contact rods 12. Interconnecting the passage 60 and the inter-contact gap of each interrupter is a conduit, or passageway, 65 extending through the center of stationary contact 30 and along the longitudinal axis of the stationary contact rod 12. As will be apparent from FIG. 1, the passages 65 and 60 define an open passageway that extends between the inter-contact gaps via a straight-line or line-of-sight path. This straight-line communication facilitates the free passage of arcing products between the two gaps, thereby improving the chances for arcing-over any inter-contact gap that is intact when arcing has begun at the other inter-contact gap.

In the illustrated form of the invention, metal tube 62 is part of a Tee fitting. The trunk 64 of the Tee constitutes a pinch-off tube through which both interrupters 10 are evacuated during their manufacture. After such evacuation, this trunk 64 is pinched off and thus sealed in a conventional manner. The passageway through the trunk 64, it will be noted, extends transversely of the main passage 60 in the fitting.

it is possible to utilize a short metal tube such as 62 for interconnecting the inter-contact gaps because the interrupters 10 are located and mounted in such a way that their end caps 24 face each other and their stationary contact rods 12 are substantially aligned and have their outer ends in close juxtaposition.

For mounting the interrupters 10 with their stationary contact rods 12 in alignment and the outer ends of the stationary contact rods in close juxtaposition, a box-like stationary frame 70 is utilized in a position between the facing end caps 24. This frame 70 includes vertically-extending spaced walls 72 and 74 to which the interrupters 10 are fixed by studs 75 integral with their end caps 24. It is to be understood that before the two interrupters are mounted on the frame 70, they are joined together by incorporation of the tube 62 while the trunk portion 64 is still open. The joined interrupters are then baked-out in a conventional manner and are evacuated through trunk portion 64, after which the trunk portion is pinched off, or sealed. The resulting assembly of the two joined and evacuated interrupters is then mounted on the frame 70. As shown in FIG. 2, suitable slots 76 and 77 are provided in walls 72 and 74 of the frame to permit the interrupter assembly to be lowered into its illustrated position without interference from the walls.

Figure 3:
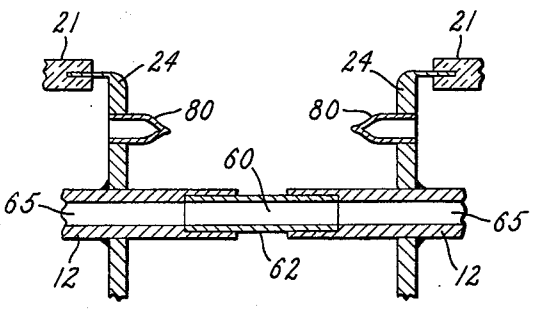
FIG. 3 is a sectional view of a portion of a modified embodiment of the invention.

Although we prefer to interconnect the interrupters with a Tee fitting 62 capable of being used for evacuating both the interrupters, as in FIG. 1, it is to be understood that the invention in its broader aspects is not so limited. For example, in another embodiment of the invention, shown in FIG. 3, we provide each interrupter with its own individual pinch-off attachment 80 through which it is evacuated in a conventional manner before seal-off. Here we use a simple tube 62 for interconnecting the two interrupters. Essentially the same straight line passage 65, 60 is present to interconnect the inter-connect gaps of the interrupters.

It will be apparent from the above that we have not modified the conventional envelopes 20 of the interrupters to accommodate the intercommunicating passage (60) between the interrupters. Because the interrupters and the passage 60 are located as shown and in free communication with the intercontact gaps, we are able to retain conventional envelopes without structural modification. There is no need to make a hole in the insulating casing 21 to accommodate any such passage, nor is there any need for a metal-to-insulating material seal such as would be required if the passage extended through the insulating casing.

Figure 4:
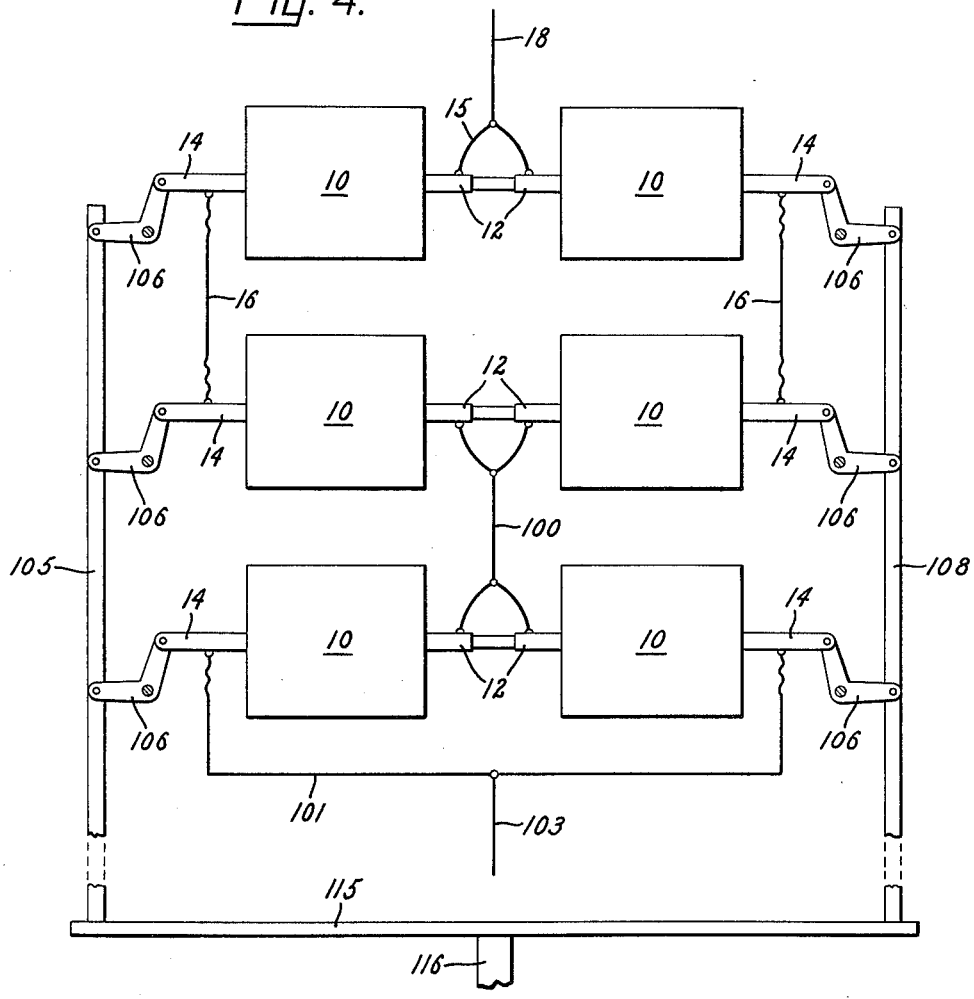
FIG. 4 is a schematic showing of a higher voltage circuit breaker including the interrupter structure of claim 1.

Although we have shown only two interrupters in the circuit breaker of FIG. 1, it is to be understood that additional interrupter assemblies, each substantially the same as that illustrated interrupter assembly to provide a circuit breaker for higher voltages. Such a higher voltage circuit breaker is schematically shown in FIG. 4, where three such interrupter assemblies are mounted in side-by-side physical relationship and are electrically connected in series. In this circuit breaker, the individual interrupters 10 of each assembly are electrically connected in parallel with each other. A first circuit-breaker terminal conductor 18 is connected to the stationary contact rods of the interrupters of the upper assembly. The upper two interrupter assemblies are interconnected by conductors 16 respectively extending between adjacent movable contact rods 14, and the lower two assemblies are interconnected by a conductor 100. The movable contact rods 14 of the lower interrupter assembly are interconnected by a conductor 101 which is connected to a terminal conductor 103.

A first operating rod 105 extends between the movable contact rods 14 of the left-hand interrupters and is coupled to each adjacent contact rod by conventional linkage means, each coupling being schematically shown as a bellcrank 106. A second operating rod 108 extends between the movable contact rods 14 of the right hand interrupters and is similarly coupled to each adjacent contact rod 14. The two operating rods 105 and 108 are coupled together for simultaneous motion as schematically shown by the crosshead 115 coupled to a common main operating rod 116.

The disclosed linkage, when actuated during an opening operation, separates the contacts of all the interrupters substantially simultaneously. Each interrupter assembly operates in the same manner as described above with respect to the interrupter assembly of FIG. 1.

Although our invention is especially adapted for use with two interrupters of a generally conventional design, it also has application in its broader aspects to interrupters especially designed for its incorporation. Such an interrupter is shown in FIG. 5, where the same reference numerals are used as in FIG. 1 to designate corresponding parts.

Figure 5:
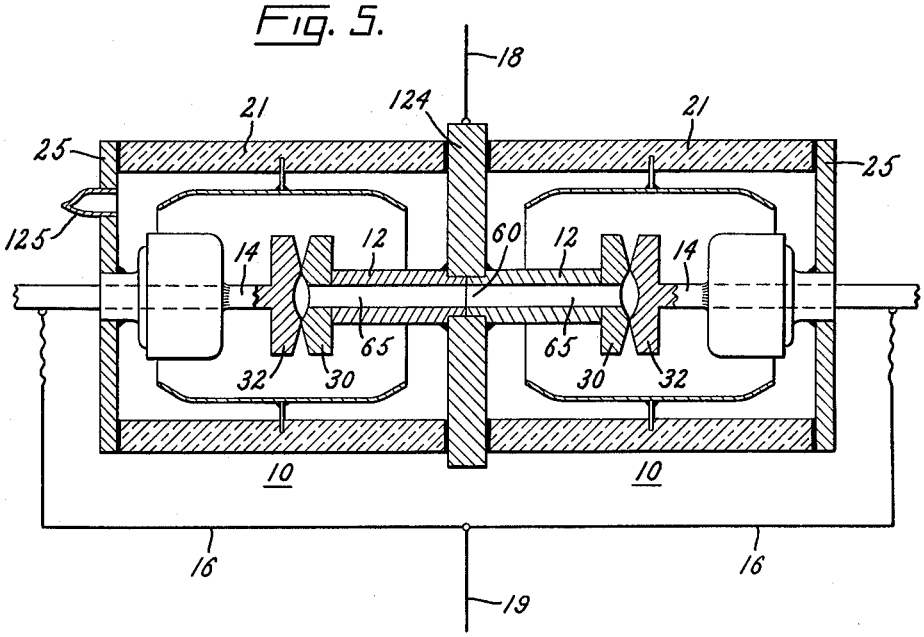
FIG. 5 illustrates another modified form of the invention.

The interrupter assembly of FIG. 5 comprises two interrupting units 10, each substantially the same as in FIG. 1, but there is a single end plate 124, preferably of copper, common to the two units and located therebetween. The insulating housings 21 of the two units are suitably joined to common end plate 24 by conventional vacuum-tight seals. The stationary contact rods 12 of the two interrupting units are joined together and to the common plate 124 by suitable brazed joints. One terminal conductor 18 is connected to plate 124, and the other terminal conductor 19 is connected through conductors 16 to the movable contact rods 14. Current entering the assembly through plate 124 divides between the two interrupting units and exists via the movable contact rods 14 and the conducters 16 connected thereto. The two interrupting units are, in effect, electrically connected in parallel with each other between terminals 18 and 19.

Suitable operating means (not shown) is provided for operating the two interrupting units to effect substantially simultaneous parting of the contacts 30, 32 in the two units. Free communication between the inter-contact gaps is provided by means of a passageway 65, 60 extending therebetween via a straight-line path. This passage serves the same function as described for the passage 65, 60 of FIG. 1.

A single pinch-off tube 125 is provided for the two interrupting units of FIG. 5 to enable them to be evacuated therethrough before the envelope comprising housings 21 and end caps 25 is sealed off during manufacture. This pinch-off tube is shown in one of the end caps 25.

In a higher voltage circuit breaker, a plurality of interrupting units, each constructed as shown in FIG. 5, are arranged in side-by-side physical relationship, electrically connected in series, and operated in the same manner as shown in FIG. 4.

While we have shown and described particular embodiments of our invention, it will be obvious to those skilled in the art that various changes and modifications may be made without departing from our invention in its broader aspects; and we, therefore, intend in the appended claims to cover all such changes and modifications as fall within the true spirit and scope of our invention.

What we claim as new and desire to secure by Letters Patent of the United States is:

1. In an electric circuit breaker, a. a pair of circuit interrupters of the vacuum-type electrically connected in parallel circuit relation with each other, b. each interrupter comprising:

i. a pair of separable contacts, one of which is movable from a closed position of engagement with the other contact to an open position spaced from the other contact, thus providing an intercontact gap between said contacts across which arcs are established during circuit-interrupting operations, ii. an evacuated envelope within which said contacts are located, said envelope comprising a casing at least partially of insulating material and an end cap at one end of said casing sealed to said casing, iii. a contact rod extending through said end cap in sealed relationship thereto and having an inner end located within said envelope and an outer end located outside said envelope, iv. and means for supporting said other contact on the inner end of said contact rod, said other contact and contact rod containing a conduit extending therethrough between said inter-contact gap and the outer end of said rod, c. means for separating the contacts of said interrupters substantially simultaneously during a circuit-interrupting operation, d. means for mounting said interrupters in such positions that said end caps of the two interrupters face each other and the outer ends of said contact rods of the interrupters are located closely adjacent each other, e. and connecting means located between the outer ends of said contact rods and providing a communicating passage between the conduits in said contact rods for conveying arcing products from any of said inter-contact gaps that is then arcing to any of said inter-contact gaps that is not then arcing, thereby promoting concurrent arcing at said gaps during high-current circuit interruption.

2. The circuit breaker of claim 1 in which the passageway comprising said conduits and said communicating passage extends between the inter-contact gaps of said two interrupters via a substantially straight-line path.

3. The circuit breaker of claim 1 in which said connecting means comprises a generally T-shaped tube having a first portion interconnecting said contact rods and defining said communicating passage and a second portion extending transversely of said first portion and defining a channel through which said envelopes are evacuated during manufacture of said interrupters.

4. In an electric circuit breaker, a. a pair of circuit interrupting units of the vacuum-type electrically connected in parallel circuit relationship with each other, b. each interrupting unit comprising:

i. a pair of separable contacts, one of which is movable from a closed position of engagement with the other contact to an open position spaced from the other contact, thus providing an inter-contact gap between said contacts across which arcs are established during circuit-interrupting operations, ii. a stationary contact rod having an inner end located adjacent said other contact, iii. means for mounting said other contact on said inner end of said stationary contact rod, iv. a conductive plate on which the outer end of said stationary contact rod is supported, said other contact and said stationary contact rod containing a conduit extending between said inter-contact gap and the other end of said rod, and v. evacuated housing means in which said pair of contacts is located, c. means for separating said pairs of contacts substantially simultaneously during a circuit-interrupting operation, d. means for mounting said interrupting units in such positions that the outer ends of said stationary contact rods of said interrupting units are closely adjacent each other and generally in alignment, e. and connecting means located between the outer ends of said contact rods and providing a communicating passage between the conduits in said contact rods for conveying arcing products from either inter-contact gap that is then arcing to either inter-contact gap that is not then arcing, thereby promoting concurrent arcing at said gaps during high-current circuit interruption.

5. The circuit breaker of claim 4 in which said conductive plate of the two interrupting units is a single member containing an opening through which extends the passageway comprising said conduits and said communicating passage.

6. The circuit breaker of claim 5 in which said passageway extends between said gaps via a substantially straight-line path.

7. The circuit breaker of claim 1 in combination with:

a. another pair of vacuum-type circuit interrupters electrically connected in parallel circuit relation with each other and constructed as defined in claim 1, b. means for connecting one of said pairs of interrupters in series with the other pair, c. and means for operating all of said interrupters substantially simultaneously.

8. The circuit breaker of claim 7 in which said means for operating all of said interrupters substantially simultaneously comprises two operating rods respectively extending between the outer ends of the movable contact rods of two of said series-connected interrupters and means for coupling said outer ends to the operating rod thereadjacent, said two operating rods being located at opposite ends of each of said pairs of vacuum interrupters.

9. The circuit breaker of claim 4 in combination with:

a. another pair of vacuum-type circuit interrupting units electrically connected in parallel circuit relationship with each other and constructed as defined in claim 4, b. means for connecting one of said pairs of interrupting units in series with the other pair, c. and means for operating all of said interrupting units substantially simultaneously.

10. The circuit breaker of claim 9 in which said means for operating all of said interrupting units substantially simultaneously comprises two operating rods respectively extending between the outer ends of the movable contact rods of a pair of said series-connected interrupting units, and means for coupling said outer ends to the operating rod thereadjacent, said operating rods being located at opposite ends of each of said pairs of vacuum-type interrupting units.

* * * * *